US007808860B2

(12) United States Patent
Masaki

(10) Patent No.: US 7,808,860 B2
(45) Date of Patent: Oct. 5, 2010

(54) ANALOG RADIO-CONTROLLED TIMEPIECE

(75) Inventor: Hiroyuki Masaki, Chiba (JP)

(73) Assignee: Seiko Instruments Inc. (JP)

( * ) Notice: Subject to any disclaimer, the term of this patent is extended or adjusted under 35 U.S.C. 154(b) by 322 days.

(21) Appl. No.: 11/985,524

(22) Filed: Nov. 15, 2007

(65) Prior Publication Data

US 2008/0130420 A1 Jun. 5, 2008

(30) Foreign Application Priority Data

Nov. 22, 2006 (JP) ..... 2006-315520

(51) Int. Cl.
*G04C 11/02* (2006.01)

(52) U.S. Cl. ..... 368/47

(58) Field of Classification Search ..... 368/46, 368/47, 52, 59
See application file for complete search history.

(56) References Cited

U.S. PATENT DOCUMENTS 4,358,836 A * 11/1982 Tohyama et al. ..... 368/47
4,650,344 A 3/1987 Allgaier et al. ..... 368/47
4,690,568 A * 9/1987 Odagiri et al. ..... 368/204
7,075,859 B2 * 7/2006 Miyahara et al. ..... 368/47
7,307,919 B2 * 12/2007 Fujisawa ..... 368/47

FOREIGN PATENT DOCUMENTS

| | | |
|---|---|---|
| EP | 0751444 | 1/1997 |
| JP | 2001159689 | 6/2001 |
| JP | 2003004873 | 1/2003 |
| WO | 0029914 | 5/2000 |

* cited by examiner

*Primary Examiner*—Vit W Miska
(74) *Attorney, Agent, or Firm*—Adams & Wilks

(57) ABSTRACT

To make such that, in a case displaying the fact that a time code could not be normally received in an analog radio-controlled timepiece, by a simple constitution there is performed a display having no sense of discomfort for a user. In a case where there could not be normally received in a time code reception operation in the last time, a second hand is normally moved by 1 second. In a case where there failed in a reception, after the second hand was normally moved till a 55-second position, the second hand is stopped at the 55-second position till a second time instant becomes 59 seconds. When it became 59 seconds, by fast-forwarding the second hand till an exact second position, the fact that the time code could not be normally received is displayed by the display having no sense of discomfort for the user without using an exclusive display means, and the like.

4 Claims, 7 Drawing Sheets

ANALOG RADIO-CONTROLLED TIMEPIECE

BACKGROUND OF THE INVENTION

1. Field of the Invention

The present invention relates to a radio-controlled timepiece correcting a time instant on the basis of a time code received by a radio, and relates especially to an analog radio-controlled timepiece analog-displaying the time instant by time instant hands.

2. Description of the Related Art

From olden times, there is utilized the radio-controlled timepiece receiving a standard radio signal including the time code denoting a present time instant by the radio, thereby correcting the time instant in an inside of the radio-controlled timepiece.

When performing a time instant correction, since it is not limited that a time code signal included in the standard radio signal can not be necessarily received normally, in order to inform whether or not the time instant correction is normally performed by normally receiving the time code, there is constituted such that it is notified to a user by stopping a second hand at a specified position, in which there is a yes/no display of a success in a last time reception, bypress-operating an operation switch other than a crown.

Further, in a timepiece in which there is attached an optical element such as liquid crystal or LED, there is constituted such that the yes/no in the last time reception is displayed by the optical element.

However, in the above radio-controlled timepiece, since an exclusive component such as operation switch or optical element is used in order to display the yes/no in a time code reception, there is an issue that the constitution becomes complicated and becomes expensive.

As a radio-controlled timepiece capable of solving this issue, there is an analog radio-controlled timepiece which has a crown for correcting the time instant and one motor for driving time instant hands (a second hand, an hour hand, a minute hand), and in which the time instant hands are driven by the above motor through train wheels, wherein, in order to inform whether or not the time code included in the standard radio signal was normally received, it is displayed by changing a hand motion interval of the second hand in a case where the time code could be normally received and a case where there failed in the reception (e.g., refer to Patent Documents JP-A-2001-159689 Gazette (Paragraphs [0021]-[0026], FIG. 1, FIG. 2) and JP-A-2003-004873 Gazette (Paragraphs [0009]-[0028], FIG. 1-FIG. 4)).

That is, in the invention described in each of the Patent Documents 1 and 2, there is made such that the user can recognize the fact that the reception of the time code failed by performing, in the case where the reception of the time code failed, a hand motion interval different from an ordinary hand motion interval, e.g., the second hand performs a hand motion (two-second hand motion) by gathering for 2 seconds every time 2 seconds elapse, or performing a continuous hand motion at an ordinary time instant display time and a step hand motion at a reception failure time.

FIG. 7 is a timing diagram of the 2-second hand motion in a conventional radio-controlled timepiece. As shown in FIG. 7, under a state failed in the time code reception, every time a time elapses 2 seconds, the second hand is driven by gathering two times on the basis of drive signals OUT 1 and OUT 2. By this, the user can recognize whether or not there failed in the reception of the time code.

However, since the special hand motion such as the above 2-second hand motion is continued till a next reception succeeds, there is an issue that the user always feels a sense of discomfort when reading the time instant. Further, there is an issue that it is impossible to know how much failed continuously in the past in the reception of the time code while accumulating.

SUMMARY OF THE INVENTION

An object of the present invention is to make such that, in a case displaying the fact that the time code could not be normally received in the analog radio-controlled timepiece, by a simple constitution there is performed the display having no sense of discomfort for the user.

Another object of the present invention is to make such that, in the case that the time code could not be normally received in the analog radio-controlled timepiece, by the simple constitution there is displayed the fact that there failed in the reception while continuing in how degree.

It is an aspect of the present invention to provide an analog radio-controlled timepiece which has a reception means receiving and outputting a time code denoting a present time instant by a radio, a clock means clocking a time instant, a time instant correction means correcting a clocked time instant of the clock means to a time instant corresponding to the time code received by the reception means, a time instant hand having at least a second hand and for displaying the time instant, one motor for rotation-driving the time instant hand, and a control means drive-controlling the motor by a drive signal corresponding to the clocked time instant of the clock means, and in which the clocked time instant of the clock means is corrected at a predetermined timing to the time instant corresponding to the time code received by the reception means, and the clocked time instant of the clock means is displayed by the time instant hand, characterized in that, when the reception means could not normally receive the time code, the control means drive-controls the motor such that the second hand is moved, after being normally moved till a 1st second position, from the 1st second position till an exact second position in a mode different from the normal hand motion.

When the reception means could not normally receive the time code, the control means drive-controls the motor such that the second hand is moved, after being normally moved till the 1st second position, from the 1st second position till the exact second position in the mode different from the normal hand motion.

Here, there may be constituted such that, when the reception means could not normally receive the time code, the control means drive-controls the motor such that the second hand is stopped after being normally moved till the 1st second position and, when there became a predetermined second time instant, it is fast-forwarded from the 1st second position till the exact second position.

Further, there may be constituted such that the 1st second position is a constant position previously determined.

Further, there may be constituted such that the 1st second position is a position corresponding to a frequency in which the reception means could not continuously, normally receive the time code.

Further, there may be constituted such that the control means has a counter means counting the frequency in which the reception means could not continuously, normally receive the time code, and the 1st second position is a second position in which there is subtracted from the exact second position by a second number corresponding to the number in which it could not continuously receive.

Further, there may be constituted such that, in a case where a counted value of the counter means denotes the fact that the frequency in which it could not continuously, normally receive the time code is below a predetermined frequency, the control means drive-controls the motor such that the second hand is stopped after being normally moved till a 2nd second position that is a constant position previously determined and, when there became the predetermined second time instant, it is moved from the 2nd second position till the exact second position in the mode different from the normal hand motion.

According to the present invention, it becomes possible that, in the case displaying the fact that the time code could not be normally received in the analog radio-controlled timepiece, by the simple constitution there is performed the display having no sense of discomfort for the user.

Further, according to the present invention, there is brought about an advantage that, in the case that the time code could not be normally received in the analog radio-controlled timepiece, by the simple constitution there is displayed the fact that there failed in the reception while continuing in how degree.

DESCRIPTION OF THE PREFERRED EMBODIMENTS

Figure 1:
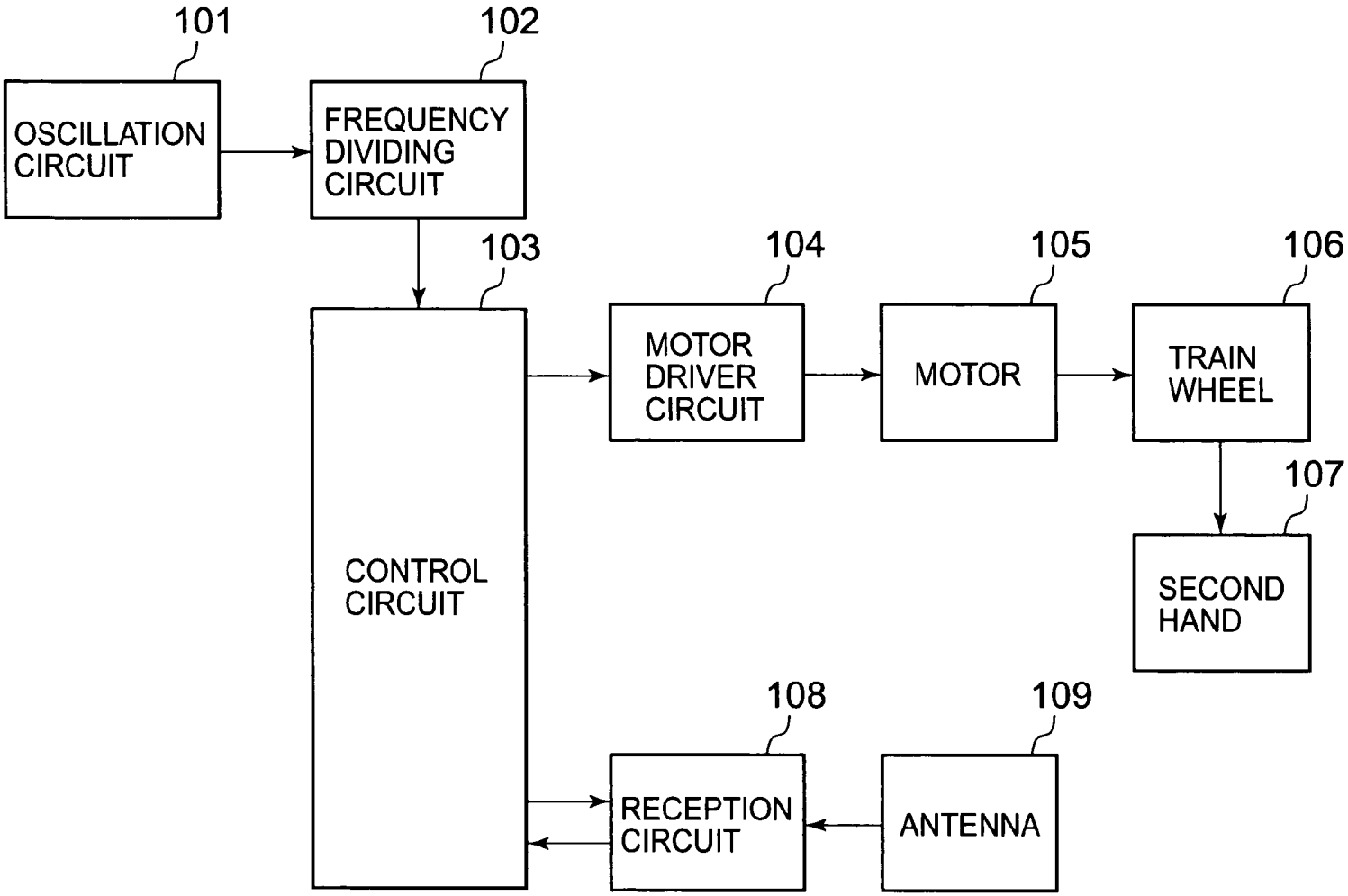
FIG. 1 is a block diagram of an analog radio-controlled timepiece concerned with an embodiment of the present invention.

FIG. 1 is a block diagram of an analog-radio-controlled timepiece concerned with an embodiment of the present invention, and is a block diagram used in common to each embodiment mentioned later.

In FIG. 1, a radio-controlled timepiece possesses an oscillation circuit 101 outputting a signal of a predetermined frequency, a frequency dividing circuit 102 outputting a time signal becoming a reference of a clock operation by frequency-dividing the signal from the oscillation circuit 101, a control circuit 103 performing, by performing the clock operation basing on the time signal, an output processing of a control signal for a time instant display, a control processing of each constituent element of the radio controlled timepiece, or a later-mentioned processing and the like, a motor driver circuit 104 responding to the control signal from the control circuit 103 to thereby output a motor drive signal, a motor 105 drive-controlled by the motor drive signal and for rotation-driving time instant hands (an hour hand, a minute hand and a second hand 107), a train wheel 106 transmitting a rotation of the motor 105, the time instant hands having the hour hand, the minute hand and the second hand 107, which are rotation-driven by the motor 105 through the train wheel 106, an antenna 109 receiving the standard radio signal including the time code by the radio, and a reception circuit 108 outputting the time code included in the standard radio signal received by the antenna 109.

Here, the control circuit 103 is clocking a present time instant by counting the time signal, and constitutes a clock means. Further, the control circuit 103 constitutes a time instant correction means which corrects the present time instant that itself is clocking to a time instant corresponding to the received time code. Further, the control circuit 103 and the motor driver circuit 104 constitute a control means drive-controlling the motor. Further, the reception circuit 108 and the antenna 109 constitute a reception means receiving the time code by the radio.

Figure 2:
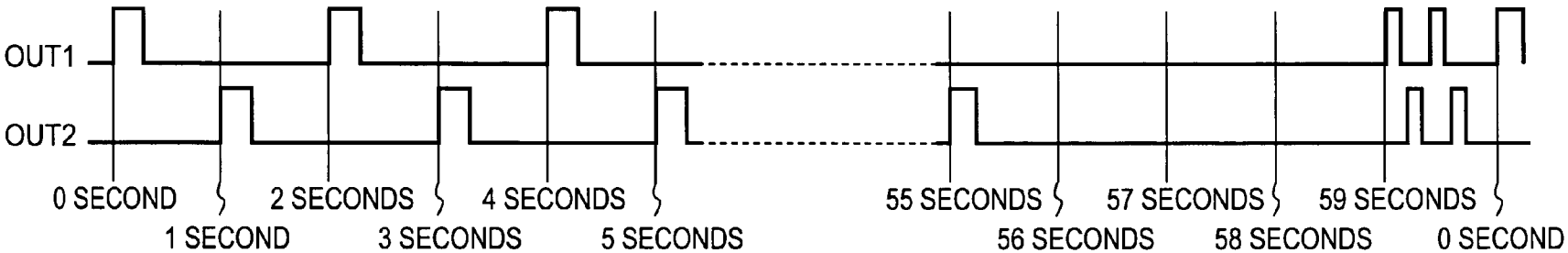
FIG. 2 is a timing diagram of a first embodiment of the present invention.

FIG. 2 is a timing diagram showing an operation of a first embodiment of the present invention.

Figure 3:
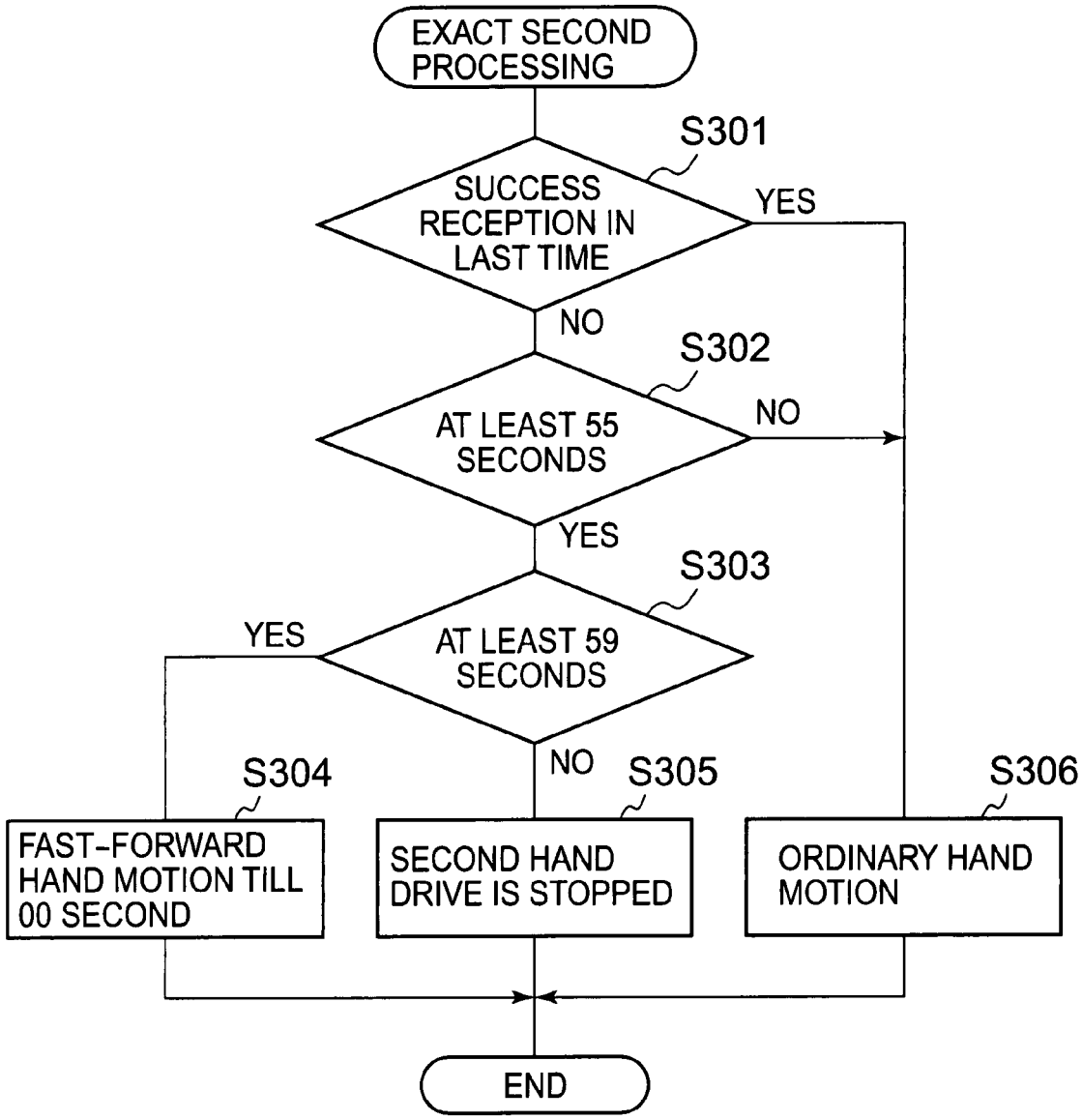
FIG. 3 is a flowchart showing processing of the first embodiment of the present invention.

FIG. 3 is a flowchart showing processing of the first embodiment of the present invention, and shows mainly the processing of the control circuit 103.

Hereunder, by using FIG. 1-FIG. 3, there is explained the operation of the analog radio-controlled timepiece concerned with the first embodiment of the present invention.

In an ordinary time instant display operation, the radio-controlled timepiece performs the clock operation by the fact that the control circuit 103 counts a timepiece signal from the frequency dividing circuit 102 in an ordinary mode performing the clock operation based on the timepiece signal from the frequency dividing circuit 102, thereby outputting a control signal, which corresponds to the clocked time instant, to the motor driver circuit 104. The motor driver circuit 104 drive-controls the motor 105 by a drive signal corresponding to the control signal.

The motor 105 performs an ordinary hand motion of the time instant hands by rotation-driving the time instant hands such as the second hand 107 through the train wheel 106, thereby performing an analog display of the present time instant. In the ordinary hand motion, the second hand 107 is step-driven in every 1 second (1-second hand motion). Incidentally, as the ordinary hand motion, there may be constituted such that the second hand 107 is sweep-moved.

In a time instant correction mode in which the time instant correction is performed by receiving the time code included in the standard radio signal, the control circuit 103 causes the reception circuit 108 to perform a reception operation of the standard radio signal by making ON an electric source of the reception circuit 108 at a predetermined timing (e.g., a predetermined time instant in midnight, a time point designated by the user, or the like). The reception circuit 108 outputs the time code included in the standard radio signal received by the antenna 109 to the control circuit 103.

The control circuit 103 corrects its own clocked time instant to the present time instant corresponding to the time code, and outputs a control signal, which corresponds to the present time instant, to the motor driver circuit 104. The motor driver circuit 104 drive-controls the motor 105 by the drive signal corresponding to the control signal, and the motor 105 rotation-drives the time instant hands including the second hand 107 through the train wheel 106, thereby performing an analog display of an accurate present time instant corresponding to the time code.

Like this, in a case where the time instant correction is performed by normally receiving the time code, the second hand 107 is ordinarily moved.

Next, there is explained about a display operation denoting the fact that the time code included in the standard radio signal could not be received normally.

The control circuit 103 has in its inside a storage means denoting whether or not the time code could be received normally in a time code reception operation in the last time. If it is judged in the above time instant correction mode that the time code is not normal by performing an error check of the time code from the reception circuit 108, and the like, the control circuit 103 judges that the time code could not be received normally, and stores an information to the effect that there failed in the reception to the storage means.

By referring to the storage means, the control circuit 103 judges whether or not the time code could be received normally in the last time (a step S301) and, when it could be received normally in the last time, controls the motor 105 such that a hand motion of the second hand 107 performs an ordinary hand motion that is a hand motion operation performing an ordinary time instant display (a step S306).

In a case where it is judged in the processing step S301 that the time code could not be received normally, the control circuit 103 judges whether or not a second time instant elapsed at least 55 seconds (a step S302) and, in a case where it does not elapse at least 55 seconds, there proceeds to the processing step S306, thereby controlling the motor 105 so as to perform the ordinary hand motion. By this, as shown in FIG. 2, the second hand 107 performs the ordinary hand motion from an exact second position (meaning a position in which the second hand coincides with a 12 o'clock position of the hour hand) to a 55-second position.

In a case where it is judged in the processing step S302 that the second time instant elapsed at least 55 seconds, the control circuit 103 judges whether or not the second time instant elapsed at least 59 seconds (a step S303) and, in a case where it does not elapse at least 59 seconds, controls the motor 105 so as to stop a drive of the second hand 107 (a step S305). By this, as shown in FIG. 2, the second hand 107 stops at the 55-second position till the second time instant elapses 59 seconds after it elapsed 55 seconds.

In a case where it is judged in the processing step S303 that the second time instant elapsed at least 59 seconds, the control circuit 103 controls (fast-forward hand motion) the motor 105 so as to fast-forward the second hand 107 till or to the exact second position (00-second position) (a step S304). By this, as shown in FIG. 2, the second hand 107 performs the fast-forward hand motion from the 55-second position to the exact second position. Accordingly, during it is stopping at the 55-second position, although an error of several seconds generates in the time instant display, it follows that an accurate time instant is displayed after there rapidly proceeded to the exact second position.

Like the above, according to the analog radio-controlled timepiece concerned with the present first embodiment, since there is constituted such that, in the case where there could be normally received in the time code reception operation in the last time, the second hand 107 is ordinarily moved and, in the case where there failed in the reception, the second hand 107 is stopped at the 55-second position till the second time instant becomes 59 seconds after the second hand 107 is normally moved till the 55-second position, and the second hand 107 is fast-forwarded till the exact second position when the second time instant became 59 seconds, it becomes possible to perform the display having no sense of discomfort for the user by the simple constitution without using an exclusive display part such as light emitting element.

Further, when the user sees the radio-controlled timepiece, in the inventions described in the above patent Documents, although an abnormal hand motion must be always seen when there failed in the reception in the last time, it is possible to confirm a reception state in the last time by seeing a hand motion change of only a certain one portion (in the present embodiment, between the 55-second position and the exact second position). That is, the second hand 107 is ordinarily moved in an almost portion during it makes one round, and it becomes possible to judge whether there succeeded or failed in the reception in the last time by the motion of the second hand in the one portion in the one round. Accordingly, in a portion other than a non-ordinary hand motion, a read of the time instant becomes possible without the sense of discomfort as an ordinary timepiece.

Figure 4A:
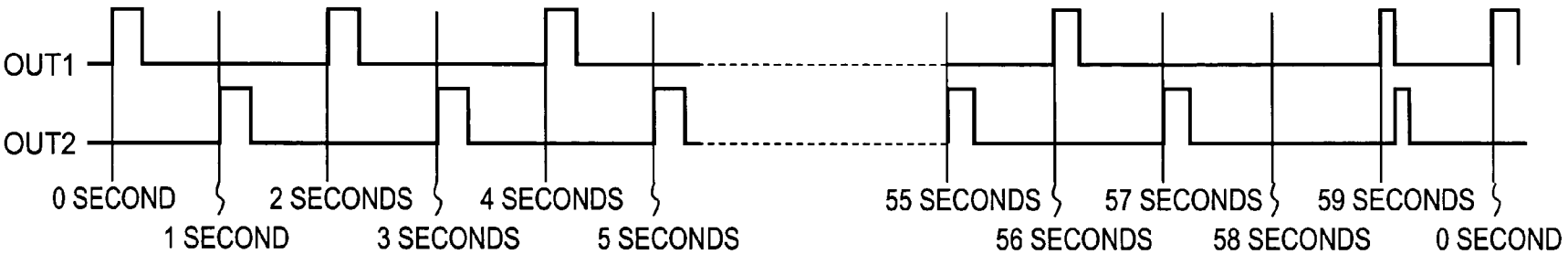
FIG. 4 is a timing diagram of a second embodiment of the present invention.
Figure 4B:
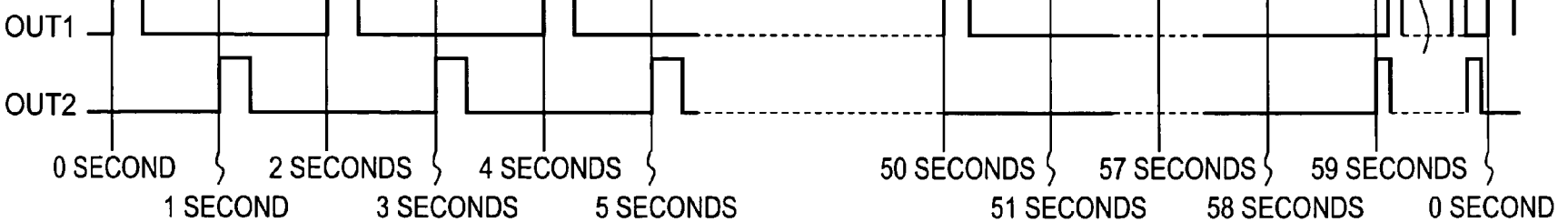

FIG. 4 is a timing diagram showing an operation of a second embodiment of the present invention.

Figure 5:
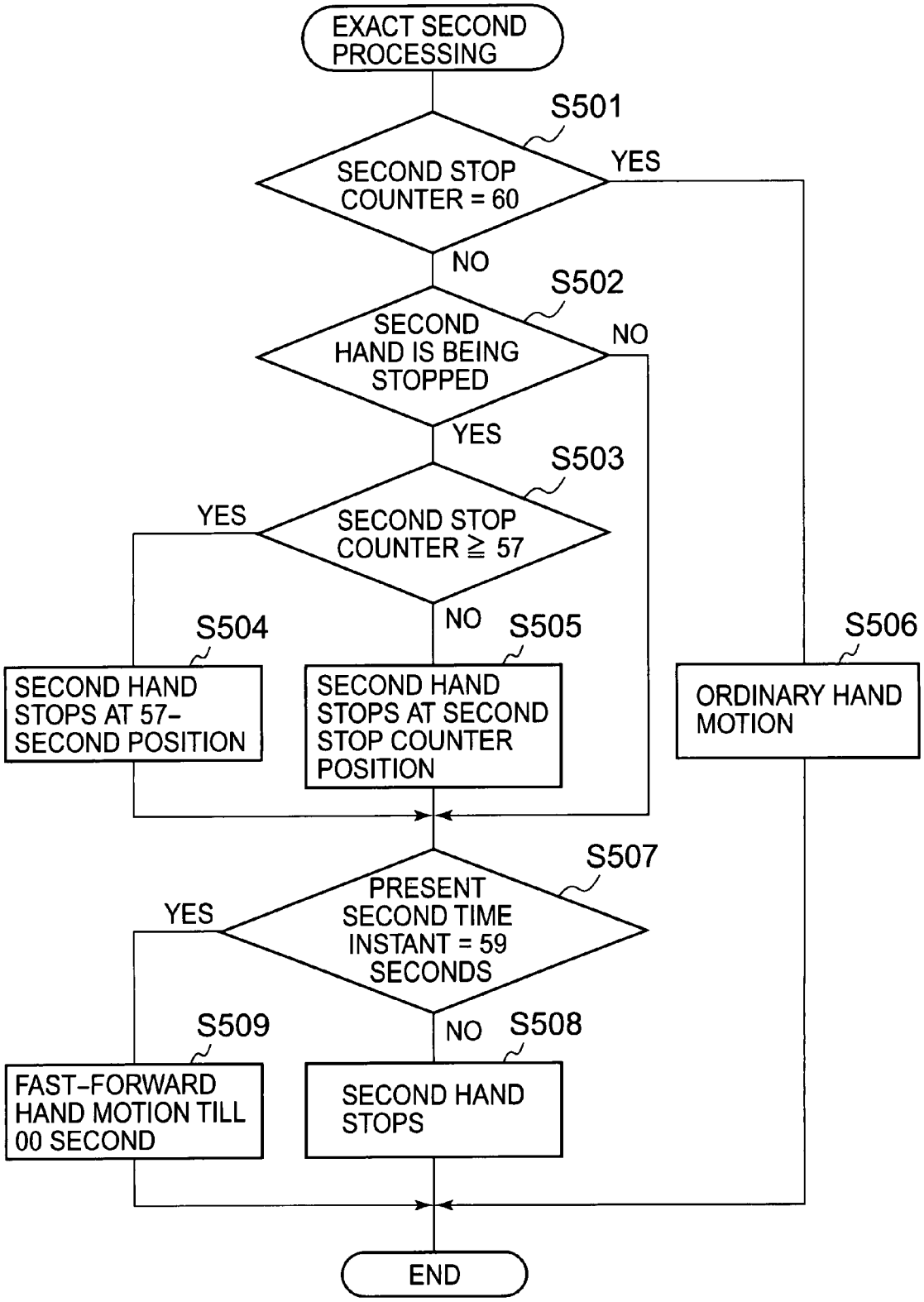
FIG. 5 is a flowchart showing processing of the second embodiment of the present invention.
Figure 6:
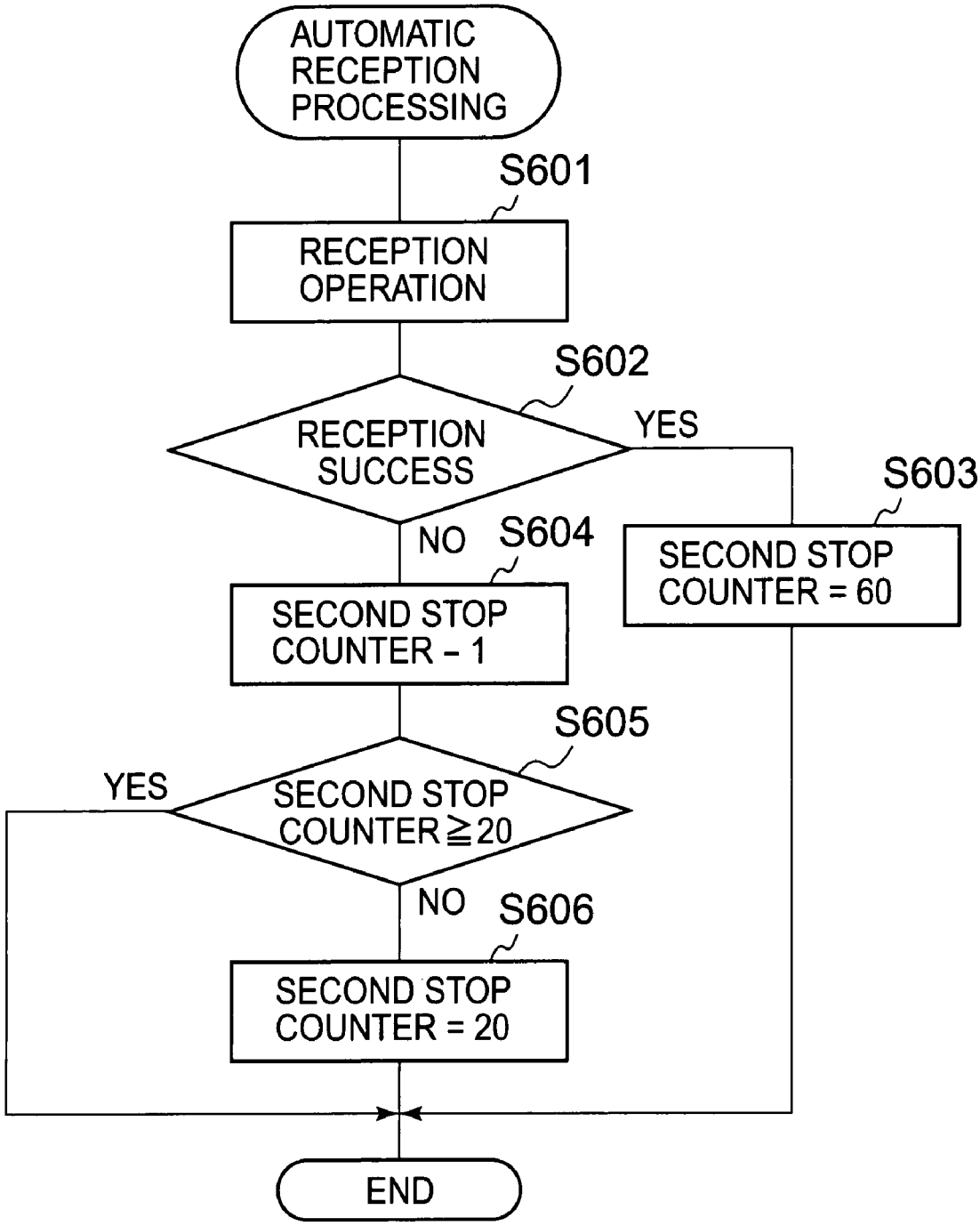
FIG. 6 is a flowchart showing processing of the second embodiment of the present invention.
Figure 7:
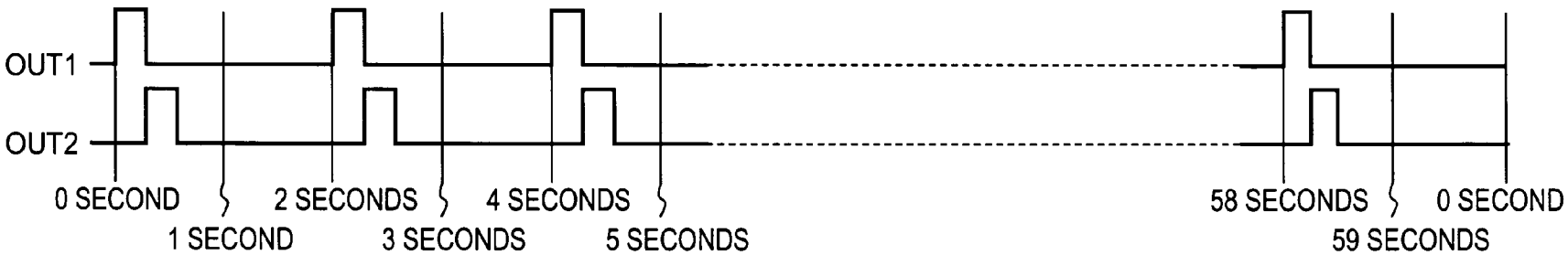
FIG. 7 PRIOR ART
FIG. 7 is a timing diagram of a conventional analog radio-controlled timepiece.

Further, FIG. 5 and FIG. 6 are flowcharts showing processing of the second embodiment of the present invention, and shows mainly the processing of the control circuit 103.

Hereunder, by using FIG. 1, and FIG. 4-FIG. 6, there is explained the operation of the analog radio-controlled timepiece concerned with the second embodiment of the present invention.

First, in the ordinary time instant display operation, similarly to the above first embodiment, in the ordinary mode performing the clock operation basing on the timepiece signal from the frequency dividing circuit 102, the control circuit 103 performs the clock operation by counting the timepiece signal from the frequency dividing circuit 102, thereby outputting the control signal, which corresponds to the clocked time instant, to the motor driver circuit 104. The motor driver circuit 104 drive-controls the motor 105 by the drive signal corresponding to the control signal.

The motor 105 performs the ordinary hand motion of the time instant hands by rotation-driving the time instant hands such as the second hand 107 through the train wheel 106, thereby performing the analog display of the present time instant by the time instant hands. In the ordinary hand motion, the second hand 107 is step-driven in every one second (1-second hand motion).

Incidentally, similarly to the above first embodiment, as the ordinary hand motion, there may be constituted so as to perform the sweep hand motion of the second hand 107.

In the time instant correction mode in which the time instant correction is performed by receiving the time code included in the standard radio signal, the control circuit 103 causes the reception circuit 108 to perform the reception operation of the standard radio signal by making ON the electric source of the reception circuit 108 at the predetermined timing (e.g., the predetermined time instant in midnight, the time point designated by the user, or the like) (a step S601 in FIG. 6). The reception circuit 108 outputs the time code included in the standard radio signal received by the antenna 109 to the control circuit 103.

In a case where it was judged that the time code was normally received by performing the error check of the time code, and the like (a step S602), the control circuit 103 sets a second stop counter in an inside of the control circuit 103 to 60, thereby finishing the processing (a step S603). The second stop counter constitutes a counter means.

In a case where it was judged in the processing step S602 that the time code could not be received normally, the control circuit 103 subtracts 1 from a counted value of the second stop counter (a step S604). The counted value of the second stop counter is a value obtained by subtracting a frequency, in which the reception circuit 108 could not normally, continuously receive the time code, from 60, i.e., a value corresponding to the frequency in which the reception circuit 108 could not normally, continuously receive the time code.

Incidentally, as to the reception operation of the time code, in a case where the time code can not be normally received, although the reception operation is consecutively performed by plural times till it can be received, these series of reception operations of the plural times are counted as the reception operation of one time in the present embodiment.

Next, in a case where the counted value of the second stop counter is at least 20, the control circuit 103 finishes the processing (a step S605) and, in a case where it is not at least 20, sets the counted value of the second stop counter to 20, thereby finishing the processing (a step S606).

Next, in a case where the time instant display is performed under a state in which there failed in the reception of the time code, if it is judged that the counted value of the second stop counter is 60 (a step S501 in FIG. 5), this case means the fact that the time code was normally received in the last time, and the control circuit 103 controls the motor 105 such that the second hand 107 always performs the ordinary hand motion (a step 506).

Next, in a case where the counted value of the second stop counter is not 60 and it is judged that the second hand 107 is being stopped (a step 502), when it is judged that the counted value of the second stop counter is less than 57 (a step 503), the control circuit 103 controls the motor 105 such that the second hand 107 stops at a second position corresponding to the counted value of the second stop counter (a step 505).

The second position in which the second hand 107 stops at this time is a second position (1st second position) corresponding to a frequency in which there continuously failed in the reception of the time code.

In a case where the control circuit 103 judged in the processing step S502 that the second hand 107 was not being stopped, there proceeds to a processing step S507.

Further, when there was judged in the processing step 503 that the counted value of the second stop counter was at least 57 seconds, the control circuit 103 controls the motor 105 such that the second hand 107 stops at a 57-second position (a step 504).

The 57-second position is a constant position (2nd second position) previously determined. By this, even in a case where a frequency in which there was impossible to continuously receive is small, it becomes easy to confirm visually the fact that there could not be received.

Next, in a case where it was judged that a present time instant was not 59 seconds (the step S507), the control circuit 103 controls the motor 105 such that the second hand 107 stops (a step S508) and, in a case where it was judged that the present time instant was 59 seconds, it drive-controls the motor 105 so as to fast-forward the second hand 107 till the exact second (a step S509).

For example, in a case where a continuous reception failure frequency till the last time is one time, the counted value of the second stop counter becomes 59, and the control circuit 103 fast-forwards the second hand 107 by the processing step S509 via the processing steps S503, S504, S507. By this, like FIG. 4(*a*), there are performed the ordinary hand motion till 57 seconds, and the fast-forward hand motion from 57 seconds till the exact second.

Further, in a case where the continuous reception failure frequency till the last time is ten times, the counted value of the second stop counter becomes 50, and the control circuit 103 fast-forwards the second hand 107 by the processing step S509 via the processing steps S503, S505, S507. By this, like FIG. 4(*b*), there are performed the ordinary hand motion till 50 seconds, and the fast-forward hand motion from 50 seconds till the exact second.

In a case where a stop position of the second hand 107 exists in a second position before than the 2nd second position (57-second position), the 1st second position that is the stop position of the second hand denotes a value corresponding to the continuous reception failure frequency till the last time. Further, in a case where the stop position of the second hand 107 exists in a second position after the 2nd second position (57-second position), there is denoted the fact that the continuous reception failure frequency till the last time is lower than the frequency corresponding to the 2nd second position.

Therefore, according to the analog radio-controlled timepiece concerned with the present second embodiment, in a case displaying the fact that the time code could not be received normally, similarly to the above first embodiment, it becomes possible to perform the display having no sense of discomfort for the user by the simple constitution.

Further, according to the analog radio-controlled timepiece concerned with the present second embodiment, by altering a position, in which the second hand is stopped, in compliance with the continuous reception failure frequency, the user can know how much times (terms) there continuously failed in the reception, so that there is brought about an advantage that it is possible to know a reliability of the time instant displayed by the indication hands.

There can be applied also to the radio-controlled timepiece utilized in countries, such as not only Japan but also the USA, in which there is used the standard radio signal for the time instant correction.

What is claimed is:

1. An analog radio-controlled timepiece comprising:

reception means for receiving and outputting a time code denoting a present time instant by a radio;

clock means for clocking a time instant;

time instant correction means for correcting a clocked time instant of the clock means to a time instant corresponding to the time code received by the reception means;

a time instant hand having at least a second hand for displaying the time instant;

one motor for rotation-driving the time instant hand; and control means for drive-controlling the motor by a drive signal corresponding to the clocked time instant of the clock means and in which the clocked time instant of the clock means is corrected at a predetermined timing to the time instant corresponding to the time code received by the reception means, and the clocked time instant of the clock means is displayed by the time instant hand;

wherein when the reception means does not normally receive the time code, the control means drive-controls the motor such that the second hand is moved, after being normally moved to a 1st second position, from the 1st second position to an exact second position in a mode different from the normal movement, wherein the 1st second position is a position corresponding to a frequency in which the reception means does not continuously, normally receive the time code, and wherein the control means has counter means for counting the frequency in which the reception means does not continuously, normally receive the time code, and the 1st second position is a second position in which there is subtracted from the exact second position a second number corresponding to the frequency in which it does not continuously receive.

2. An analog radio-controlled timepiece comprising:

reception means for receiving and outputting a time code denoting a present time instant by a radio;

clock means for clocking a time instant;

time instant correction means for correcting a clocked time instant of the clock means to a time instant corresponding to the time code received by the reception means;

a time instant hand having at least a second hand for displaying the time instant;

one motor for rotation-driving the time instant hand; and control means for drive-controlling the motor by a drive signal corresponding to the clocked time instant of the clock means and in which the clocked time instant of the clock means is corrected at a predetermined timing to the time instant corresponding to the time code received by the reception means, and the clocked time instant of the clock means is displayed by the time instant hand;

wherein when the reception means does not normally receive the time code, the control means drive-controls the motor such that the second hand is moved, after being normally moved to a 1st second position, from the 1st second position to an exact second position in a mode different from the normal movement, wherein when the reception means does not normally receive the time code, the control means drive-controls the motor such that the second hand is stopped after being normally moved to the 1st second position and, when at a predetermined second time instant, it is fast-forwarded from the 1st second position to the exact second position, wherein the 1st second position is a position corresponding to a frequency in which the reception means could not continuously, normally receive the time code, and wherein the control means has counter means for counting the frequency in which the reception means does not continuously, normally receive the time code, and the 1st second position is a second position in which there is subtracted from the exact second position a second number corresponding to the frequency in which it does not continuously receive.

3. An analog radio-controlled timepiece according to claim 1; wherein in a case where a counted value of the counter means denotes the fact that the frequency in which the reception means could not continuously, normally receive the time code is below a predetermined frequency, the control means drive-controls the motor such that the second hand is stopped after being normally moved to a 2nd second position that is a constant position previously determined and, at the predetermined second time instant, it is moved from the 2nd second position to the exact second position in the mode different from the normal hand motion.

4. An analog radio-controlled timepiece according to claim 2; wherein in a case where a counted value of the counter means denotes the fact that the frequency in which the reception means does not continuously, normally receive the time code is below a predetermined frequency, the control means drive-controls the motor such that the second hand is stopped after being normally moved to a 2nd second position that is a constant position previously determined and, at the predetermined second time instant, is moved from the 2nd second position to the exact second position in the mode different from the normal hand motion.

* * * * *